US008009856B2

(12) United States Patent
Funahashi

(10) Patent No.: US 8,009,856 B2
(45) Date of Patent: Aug. 30, 2011

(54) SPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 1106 days.

(21) Appl. No.: 11/662,052

(22) PCT Filed: Sep. 26, 2006

(86) PCT No.: PCT/JP2006/319051

§ 371 (c)(1),
(2), (4) Date: Mar. 7, 2007

(87) PCT Pub. No.: WO2007/043331

PCT Pub. Date: Apr. 19, 2007

(65) Prior Publication Data

US 2009/0262971 A1 Oct. 22, 2009

(30) Foreign Application Priority Data

Oct. 11, 2005 (JP) ..... 2005-296285

(51) Int. Cl.
*H04R 1/00* (2006.01)
*H04R 9/06* (2006.01)
*H04R 11/02* (2006.01)

(52) U.S. Cl. ..... 381/398; 381/400

(58) Field of Classification Search ..... 381/396, 381/398, 400, 403, 404, 407, 412, 433
See application file for complete search history.

(56) References Cited

U.S. PATENT DOCUMENTS

| | | | |
|---|---|---|---|
| 5,625,701 | A | 4/1997 | Scanlan |
| 6,621,912 | B2 | 9/2003 | Sugiyama et al. |
| 6,627,140 | B1 | 9/2003 | Sato et al. |
| 7,072,485 | B2 | 7/2006 | Sato et al. |
| 7,542,583 | B2 | 6/2009 | Funahashi |
| 2003/0185415 | A1 | 10/2003 | Funahashi et al. |
| 2004/0094356 | A1 | 5/2004 | Sato et al. |
| 2004/0094357 | A1 | 5/2004 | Sato et al. |

FOREIGN PATENT DOCUMENTS

| | | |
|---|---|---|
| CN | 1273015 | 11/2000 |
| JP | 57-74599 | 5/1982 |
| JP | 2001-245388 | 9/2001 |
| JP | 2003-219498 | 7/2003 |
| JP | 2004-007332 | 1/2004 |
| JP | 2005-252924 | 9/2005 |
| KR | 20-0140017 | 5/1999 |

*Primary Examiner* — Tuan Nguyen
(74) *Attorney, Agent, or Firm* — Wenderoth, Lind & Ponack, LLP.

(57) ABSTRACT

An uncured fluid adhesive is charged into a groove surrounding the outer circumference of a voice coil so that the inner circumferential edge of a diaphragm is immersed in the adhesive. The cured adhesive securely bonds the diaphragm to the voice coil, and thus the diaphragm can be driven at high output.

2 Claims, 3 Drawing Sheets

SPEAKER

This application is a U.S. national phase application of PCT International Application PCT/JP2006/319051, filed Sep. 26, 2006.

TECHNICAL FIELD

The present invention relates to the structure of a speaker.

BACKGROUND ART

FIG. 3 is a partially sectional view of a conventional speaker. Voice coil 22 is disposed in the magnetic gap in magnetic circuit 21. The inner circumferential edge of diaphragm 23 is connected to voice coil 22. The outer circumferential edge of diaphragm 23 is coupled to frame 25 via edge 24. The backside of diaphragm 23 is coupled to frame 25 via suspension holder 26 and edge 27. The symmetrical structure of edges 24 and 27 allows diaphragm 23 to vibrate as symmetrically as possible in the vertical direction, thereby reducing distortion of the speaker. This conventional art is disclosed in Japanese Patent Unexamined Publication No. 2004-7332, for example.

The conventional speaker of FIG. 3 has low distortion even when diaphragm 23 is vibrated with large amplitude to increase output thereof. However, the connection between diaphragm 23 and voice coil 22 may be damaged by the excessive load imposed thereon.

SUMMARY OF THE INVENTION

A speaker of the present invention includes: a frame; a magnetic circuit disposed in the frame; a voice coil disposed movably with respect to the magnetic gap in the magnetic circuit; a groove surrounding the outer circumference of the voice coil; a diaphragm having an inner circumferential edge disposed in the groove, and an outer circumferential edge coupled to the frame via a first edge; and a suspension holder connected to the backside of the diaphragm and having an outer circumferential edge coupled to the frame via a second edge. The inner circumferential edge of the diaphragm is bonded to the voice coil by an adhesive charged into the groove. The diaphragm and voice coil are securely bonded and this high bonding strength can increase the output of the speaker.

DETAILED DESCRIPTION OF PREFERRED EMBODIMENT

Figure 1:
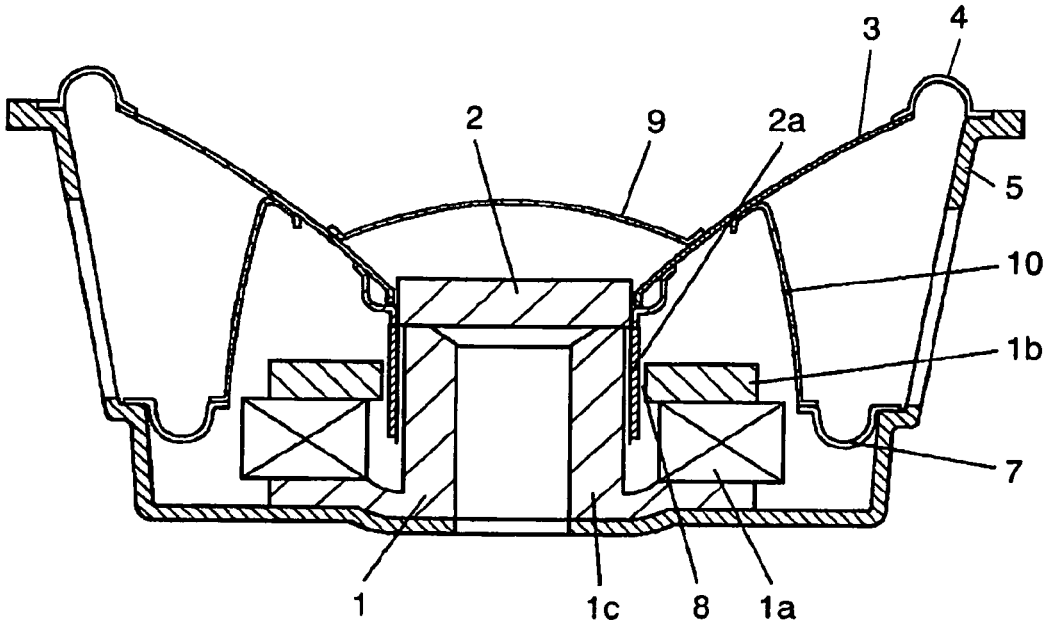
FIG. 1 is a sectional view of a speaker in accordance with an exemplary embodiment of the present invention.

Hereinafter, a description is provided of an exemplary embodiment of the present invention, with reference to the accompanying drawings. FIG. 1 is a sectional view of a speaker in accordance with an exemplary embodiment of the present invention. Magnetic circuit 1 is disposed in the center of the bottom of frame 5. Magnetic circuit 1 includes disk-shaped magnet 1*a*, disk-shaped plate 1*b*, cylindrical yoke 1*c*, and magnetic gap 8 formed between plate 1*b* and yoke 1*c*.

Voice coil 2 is disposed to be vertically movable with respect to magnetic gap 8, and vertically vibrates diaphragm 3, i.e. the sound source of the speaker, connected to voice coil 2. Dustproof dust cap 9 is provided over voice coil 2.

The outer circumferential edge of diaphragm 3 is coupled to the open end of frame 5 via edge 4 (first edge). The inner circumferential edge of diaphragm 3 is bonded to voice coil 2. Suspension holder 10 is bonded to the backside of diaphragm 3. The outer circumferential edge of suspension holder 10 is coupled to frame 5 via edge 7 (second edge). Suspension holder 10 is a mass added to diaphragm 3 and thus decreases the efficiency of the speaker. For this reason, preferably, the suspension holder is as lightweight as possible, and made of pulp or resin.

Edges 4 and 7 are made of a material, such as urethane, expanded rubber, styrene-butadiene rubber (SBR), and cloth, so that the edges do not impose a dynamic load on diaphragm 3 and suspension holder 10. Edge 4 projects upwardly. Edge 7 projects downwardly. The symmetrical structure of edges 4 and 7 decreases the distortion generated when diaphragm 3 vertically vibrates.

Figure 2:
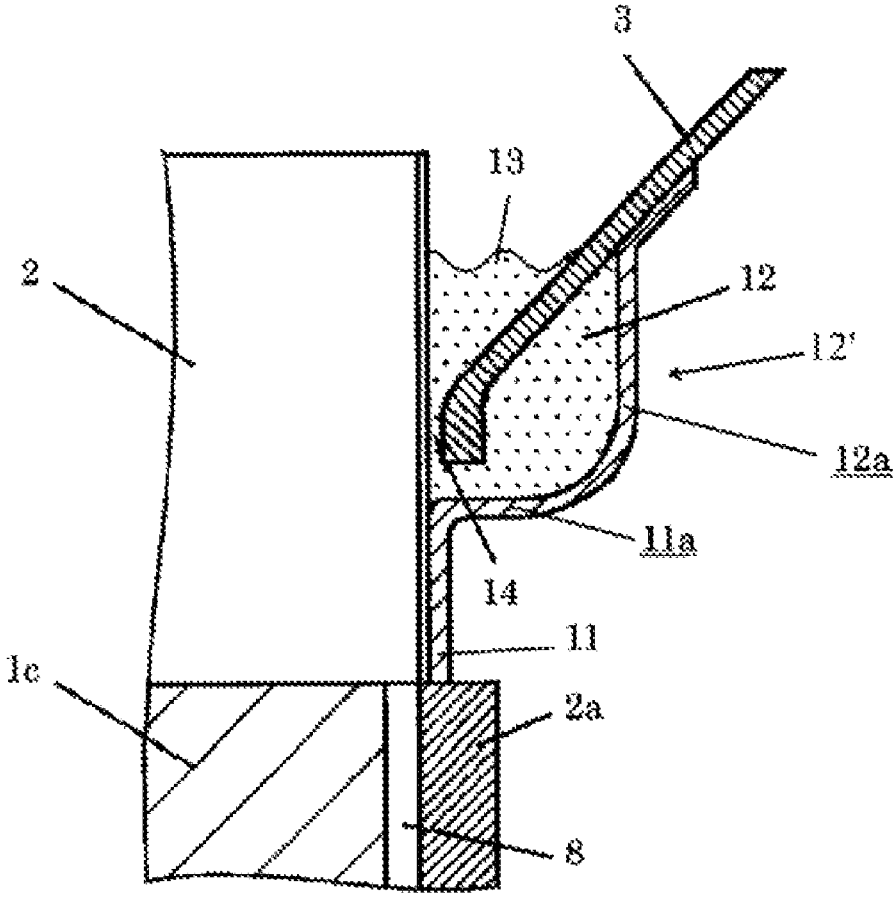
FIG. 2 is an enlarged sectional view of an essential part of the speaker.
Figure 3:
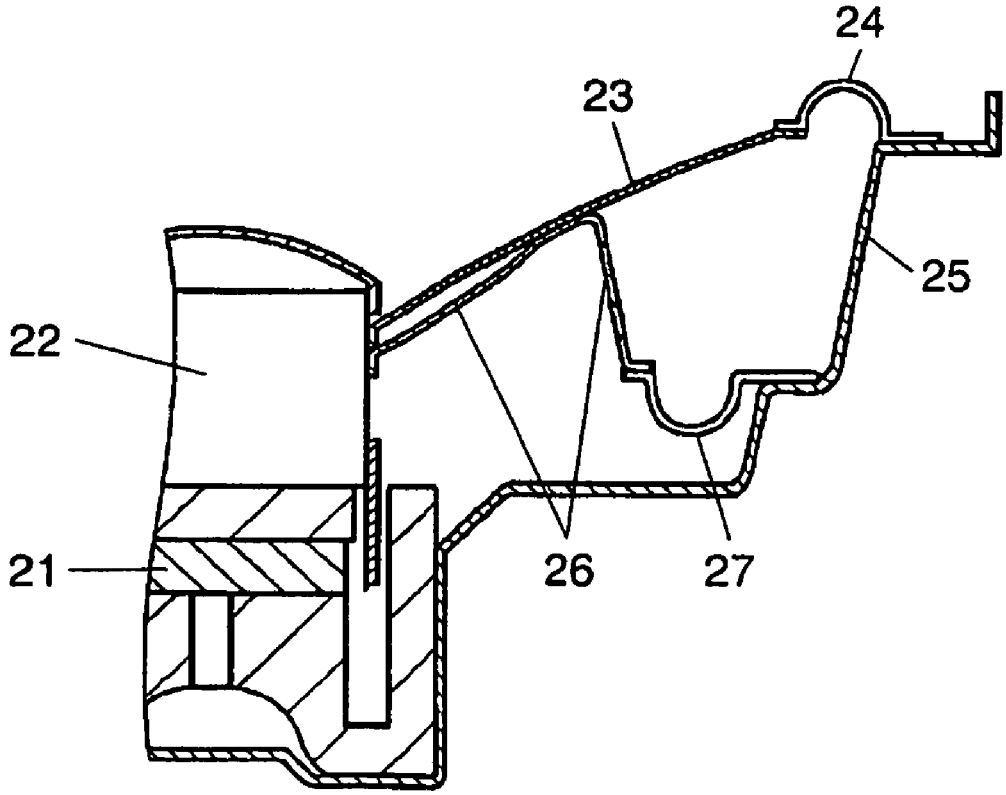
FIG. 3 is a partially sectional view of a conventional speaker.

FIG. 2 illustrates how diaphragm 3 is bonded to voice coil 2. Adhesive receiver member 12' includes adhesive receiver 12*a* surrounding the outer circumference of voice coil 2 such that adhesive-receiving groove 12 is formed about voice coil 2, and extending portion 11 extending downwardly along the voice coil 2 from bottom part 11*a* of the adhesive receiver 12*a* to be in contact with coil (i.e., coil winding) 2*a* of voice coil 2 to position groove 12. The dimension of the upper end of coil 2*a* of voice coil 2 is precisely controlled. Thus, bringing extending portion 11 of adhesive receiving member 12' into contact with the upper end of coil 2*a* allows diaphragm 3 to precisely be positioned with respect to voice coil 2.

Uncured fluid adhesive 13 is charged into groove 12 so that the inner circumferential edge of diaphragm 3 is immersed in adhesive 13. Alternatively, after the inner circumferential edge of diaphragm 3 is disposed in groove 12, uncured adhesive 13 is charged into groove 12. To allow adhesive 13 to flow easily, clearance 14 is provided between the outer circumference of voice coil 2 and diaphragm 3. Cured adhesive 13 integrally bonds the inner surface of groove 12, outer circumference of voice coil 2, and diaphragm 3.

For this reason, acrylic adhesives used by the reaction of two liquids are suitable as adhesive 13, because such adhesives have high fluidity when uncured, and dry quickly. As a result, diaphragm 3 is securely bonded to voice coil 2, and can be driven at high output.

The present invention can provide a speaker having reduced distortion and a diaphragm driven at high output, and thus is useful as a speaker with high output and low distortion.

The invention claimed is:

1. A speaker comprising:

a frame;

a magnetic circuit disposed in the frame;

a voice coil disposed movably with respect to a magnetic gap in the magnetic circuit, said voice coil including a coil winding;

an adhesive receiver member including an adhesive receiver surrounding an outer circumference of the voice coil such that an adhesive-receiving groove is formed about the voice coil, and an extending portion extending downwardly along the voice coil from a bottom of the adhesive receiver to be in contact with the coil winding of the voice coil so as to position the adhesive receiver with respect to the voice coil;

a diaphragm having an inner circumferential edge disposed in the groove, and an outer circumferential edge coupled to the frame via a first edge;

a suspension holder connected to a backside of the diaphragm and having an outer circumferential edge coupled to the frame via a second edge; and an adhesive charged in the groove;

wherein the inner circumferential edge of the diaphragm is bonded to the voice coil by the adhesive.

2. The speaker of claim 1, wherein a clearance is provided between the inner circumferential edge of the diaphragm and the voice coil.

* * * * *